United States Patent [19]

Newsome

[11] 4,330,116

[45] May 18, 1982

[54] BUNDLING MECHANISM FOR SIGNATURES

[76] Inventor: John R. Newsome, R.R. #1, Box 58A, Shumway, Ill. 62461

[21] Appl. No.: 198,344

[22] Filed: Oct. 20, 1980

[51] Int. Cl.[3] ..... B65H 29/40

[52] U.S. Cl. ..... 271/178; 271/185; 271/216; 271/221; 271/224

[58] Field of Search ..... 271/306, 178, 181, 185, 271/216, 221, 222, 224

[56] References Cited

U.S. PATENT DOCUMENTS

| | | | |
|---|---|---|---|
| 1,580,342 | 4/1926 | Staude | 271/185 |
| 2,841,394 | 7/1958 | Stobb | 271/185 |
| 3,971,554 | 7/1976 | Stange | 271/212 X |

*Primary Examiner*—Richard A. Schacher

*Attorney, Agent, or Firm*—Leydig, Voit, Osann, Mayer & Holt, Ltd.

[57] ABSTRACT

A bundling mechanism for receiving a stream of signatures in overlapping relation on a conveyor belt and for stacking them in register with one another preparatory to separation into bundles for transfer or storage. A twisting conveyor is provided for helically twisting the stream of signatures substantially 90 degrees so that the signatures are placed on edge. The outlet of the twisting conveyor is formed of a pair of vertically oriented rollers defining an outlet nip. A stop horizontally spaced from the nip arrests and accumulates the signatures thereby establishing the remote surface of the stack, the stack being supported on a table extending horizontally at right angles to the direction of the incoming stream. The near surface of the stack is horizontally spaced from the nip, the space being bridged by an auxiliary conveyor driven substantially at stream speed for incrementally conveying the trailing edge of each signature from the nip into a position which is flush with the near surface of the stack. Packer discs having rollers spaced about the periphery are provided for continuously beating upon the forming end of the stack with the blows being applied in unison over the area of the forming end to facilitate advancement of the stack and sliding of the signatures over one another from the overlapping state into a condition of precise monolithic register. A conveyor integrated into the stack supporting table assists the packer discs in advancing the major portion of the stack.

24 Claims, 14 Drawing Figures

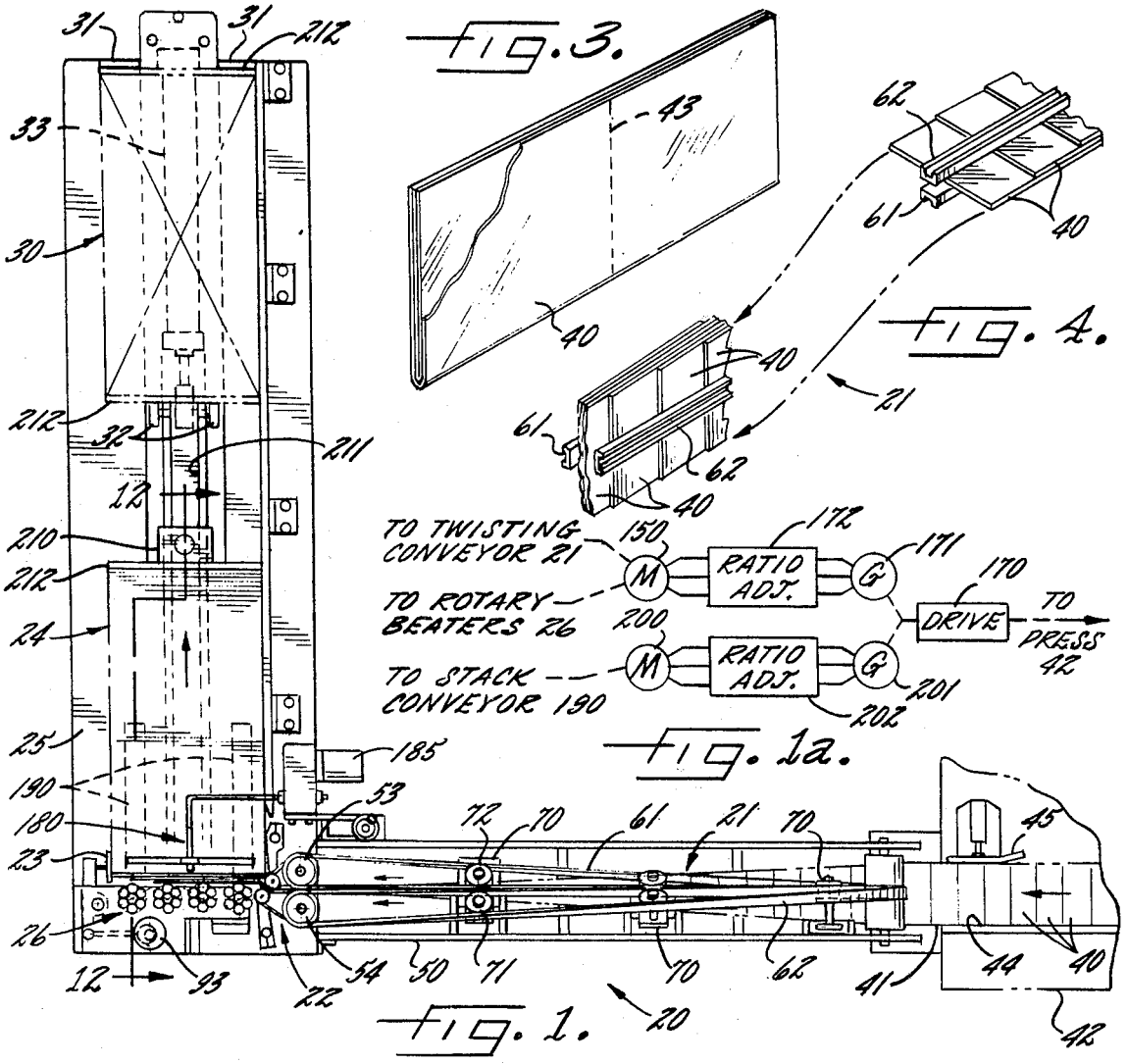
FIG. 3.
FIG. 4.
FIG. 1a.
FIG. 1.
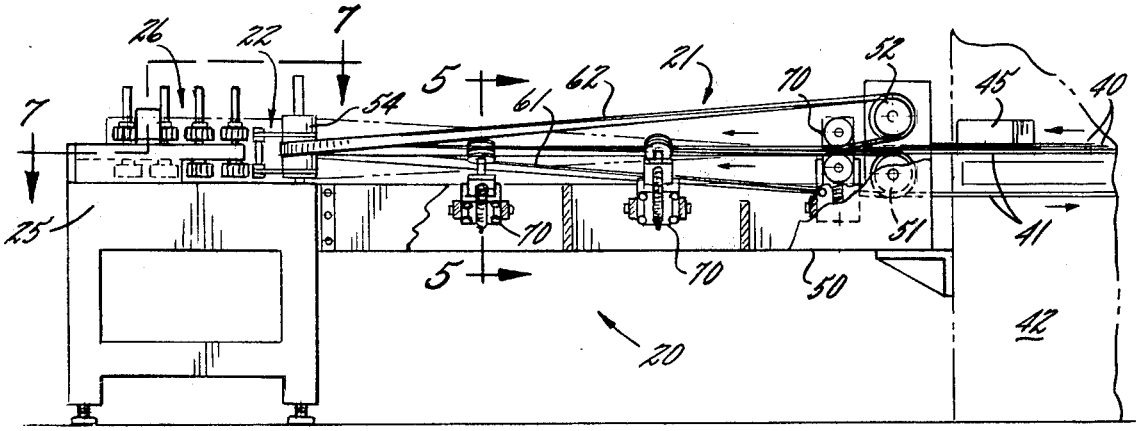
FIG. 2.

24
104
103
55
53
190
95
121
122
107
402
DS
140
133
102
101
60
100
98
125
134
111
110
40
112
123
54
113
133
130
α
56
126
132

24
95
55
190
103
53
S
140
101
125
102
60
100
133
110
111
112
113
54
132
134
130
126
56

BUNDLING MECHANISM FOR SIGNATURES

Signatures, that is, folded groups of printed pages, are usually discharged from a printing press in an overlapped stream on a horizontal conveyor belt. To form a bundle of signatures for loading into a binding machine, or which may be steel-strapped together for purposes of transfer or storage, it is necessary to block forward movement of the signatures in a condition of mutual register, which involves sliding of the signatures over one another from the overlapped state. The stacking mechanism of a conventional bundling machine cannot positively propel a signature into its final position in the stack since reliance is normally placed upon friction between each signature and the ones which follow it to achieve the last bit of registering movement. Unfortunately, there is friction, also, between each signature and its predecessor which often results in an erratic sticking condition, with the result that a signature may fall short of its registered position. When this happens the trailing edge of the signatures is either crushed by the action of the conveyor or projects beyond the confines of the stack into a position in which it is vulnerable to damage when the bundle is subsequently handled. Grossly misregistered signatures are usually unusable and must be laboriously removed. Even where mis-register is slight it causes register-related problems in the assembling and binding machine which may result in faulty or unsaleable volumes. Poor stacking and the resultant crushing of the trailing edge of a signature is particularly likely to happen where the signatures are formed of thin or relatively limp paper stock.

It is, accordingly, an object of the present invention to provide a bundling mechanism which is capable of collecting, in a horizontally oriented stack, a stream of signatures which are received on a conveyor belt at relatively high speed and in overlapping relation. It is a more specific object to produce a horizontal stack of signatures in accurate register and which results in a bundle having a precise "monolithic" appearance. This is in spite of all of the possible variations in operating conditions which may be encountered in a practical installation including variations in the dimensions of the signature, variations in the thickness and the friction characteristics of the paper stock, variations in speed, variations in the received position of the signature on the belt including degree of overlap, variations in humidity, variations in the ink, its solvent content, and the like.

It is a related object to provide a bundling machine capable of producing a precisely registered stack of signatures which is capable of acting upon high quality signatures finely printed on thin paper stock without marring either the printed surfaces or the edges of the signature. Indeed it is an object to produce a bundling machine which is universally usable with presses where either quality or high volume is the primary aim.

It is an object of the invention to provide a stacking assembly for use in a bundler having a remote stop which determines the remote surface of the stack in which each signature is individually, positively and uniformly conveyed to the remote stop without reliance upon the frictional drag between the signature and the immediately following signatures which are in overlapping relation. It is a related object to provide a stacking assembly in which the trailing end of each signature is separated from the adjacent incoming signatures and acted upon individually to achieve the last little bit of movement resulting in perfect register. It is more specifically an object to provide a stack or assembly in which the incoming stream of signatures is diverted, or bent, in the direction of the stack. This not only separates the trailing edge of the registering signature for special treatment but produces a V-shaped throat or clearance space to facilitate entry of the incoming signatures.

It is another object to provide a bundler which produces a stack which may safely grow to a length much greater than the stacks of conventional bundlers, permitting the making of larger bundles and with the stack thus enabled to serve as a reservoir providing buffer storage between the stacker and the station where the bundles are sized and banded. This enables removal and banding to take place at a more relaxed pace. The length and reaction force of the stack do not affect the precision of the stack as it is continuously formed. It is one of the features of the present invention that the stacker is capable of handling signatures which are accidentally in the underlapped state, a condition that sometimes occurs and that conventional stacker mechanisms cannot tolerate.

It is another detailed object to provide a bundler which is capable, with only minor modification or adjustment, of handling signatures having a wide range of face dimension and thickness. Similarly it is an object to provide a bundling machine which, while intended for the handling of individual signatures fed from a printing press, may be used with equal advantage for the bundling of magazines conveyed in overlapped condition from a magazine assembly line.

It is a further object of the invention to provide a bundling mechanism which can be relied upon to operate accurately and consistently over long high speed printing runs and a mechanism which is inherently long wearing and which requires a minimum of maintenance.

It is yet another object of the invention to provide a bundler for signatures which, notwithstanding its many features and advantages, is of relatively simple construction and highly economical, capable of being produced at a price which is approximately half that of bundling mechanisms of conventional construction intended to do the same job.

Other objects and advantages of the invention will become apparent upon reading the detailed description and upon reference to the drawings, in which:

FIG. 1 shows, in plan view, a bundling mechanism constructed in accordance with the invention with the forming stack extending horizontally at right angles to the direction of the stream of signatures.

FIG. 1*a* is a schematic diagram of a slaved driving system which may, for example, be of the servo type.

FIG. 2 is an elevational view corresponding to FIG. 1.

FIG. 3 shows an individual signature, in this case a "double" signature.

FIG. 4 illustrates diagrammatically the 90 degree twist which is imparted to the overlapped stream.

Figures 5, 6, 7:
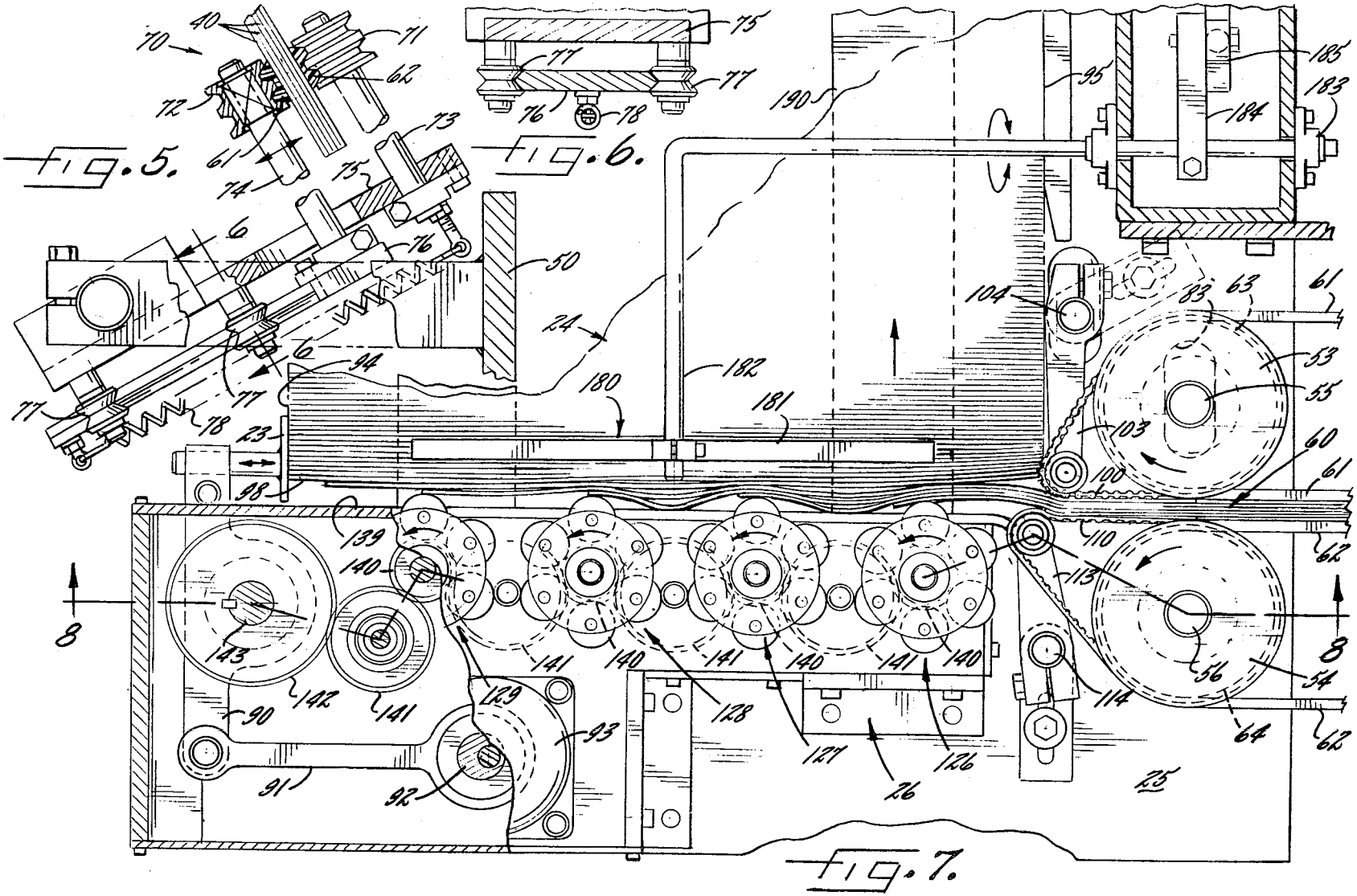
FIG. 5 is a fragmentary section viewed along line 5—5 in FIG. 2 showing an idler assembly used in the twisting conveyor.
FIG. 6 is a fragment taken along line 6—6 in FIG. 5.
FIG. 7 is a fragmentary top view showing the auxiliary bridging conveyor and showing the packer discs, remote stop and tamper operating upon the forming end of the stack.

While the invention has been described in connection with a preferred embodiment, it will be understood that I do not intend to be limited to the particular embodiment shown but intend, on the contrary, to cover the various alternative and equivalent arrangements included within the spirit and scope of the appended claims.

Turning now to FIGS. 1 and 2 there is shown a signature bundling mechanism 20 constructed in accordance with the present invention. It inclues a twisting conveyor 21 for conveying a stream of signatures, an auxiliary bridging conveyor 22, and a remote stop 23 for arresting forward movement of the signatures. The accumulated signatures form a horizontal stack 24 which rests upon a table 25 at right angles to the incoming stream. Arranged parallel to the forming end of the stack are a set of rotary beaters 26. When the stack has reached an appropriate length the leading portion is separated to define a bundle 30 for removal from the table in the compressed state. The bundle may be compressed between a fixed stop 31 at the end of the table 25 and a pair of power operated jaws 32 for banding or for removal by an overhead crane.

Individual signatures 40 (see FIG. 3) are supplied to the twisting conveyor 21 in overlapping relation on a conveyor belt 41 leading from a press 42. Each signature is arranged on belt 41 on top of the signature which precedes it in a uniform shingled relation, with the leading edges in a practical case being spaced apart a distance of two inches. This condition is to be distinguished from the opposite shingled condition of "underlap" in which the leading edge of each signature lies under that of the preceding signature in the series, a condition to which later reference will be made. In the present instance the signature is of double length as measured parallel to the binding edge for later severing along a dividing line 43. For insuring that the incoming signatures are in proper lateral position they are lightly pressed against a reference edge 44 by a shoe 45.

Turning first to the twisting conveyor 21, it includes a pair of inlet rollers and a pair of outlet rollers arranged at 90 degrees with respective rollers in each pair being interconnected by narrow centrally positioned twisting conveyor belts having adjacent runs face to face for gripping of the stream of signatures between them. Thus the signatures are advanced while being twisted in a helical path so that they are discharged in a vertically oriented position. The twisting conveyor is mounted upon a frame 50 in which are journaled a pair of inlet rollers 51, 52 and a pair of outlet rollers 53, 54 having shafts 55, 56, respectively, which project downwardly through a table 57 for cantilevered support in respective bearings 58, 59, the rollers 53, 54 forming between them an outlet nip 60.

Trained about the rollers 51, 53 is a first belt 61 and about the rollers 52, 54 is a second belt 62. The inlet and outlet rollers are grooved, as at 63, 64 with grooves which register with the belt cross section for substantially accommodating the radial thickness of the belts.

The particular belt cross section which is preferred is the "twin" V-belt formed of two "V" elements symmetrically spaced side by side but integral with one another and preferably formed of polyurethane. Such belting is commercially available from Eagle Belting Company of DesPlaines, Ill. 60018.

For the purpose of captively guiding the belts parallel to one another for even distribution of twist and for maintaining a normal force between them so that the signatures do not slide relatively to one another as they are transported, a spaced set of three idler pulley assemblies 70 are provided arranged at progressive angles. Taking the "downstream" idler assembly 70 as typical, and which is shown in FIG. 5, it consists of a relatively stationary idler pulley 71 and a movable idler pulley 72. The pulleys are mounted upon shafts 73, 74 which are carried by respectively fixed and movable frame plates 75, 76. The movable plate 76 is guided between pairs of grooved rollers 77, with bias being provided by a biasing spring 78.

A somewhat similar mounting arrangement is employed for the output roller 53, enabling it to "come and go" with variations in thickness of the incoming stream of signatures under a spring biasing force. Thus the bearing 58 which mounts the shaft 55 of roller 53 is mounted upon a plate 80 which is engaged at its edges by pairs of guide rollers 81 and with the biasing force being supplied by a pair of springs 82. For accommodating the lateral movement of roller shaft 55, an elongated clearance opening 83 is provided in the table 25.

As a result of the twisting conveyor 21, the signatures which are received from the press on conveyor 41 in the horizontal shingled relation are maintained in their relative positions but twisted substantially 90 degrees so that they are discharged from the nip 60 between the vertically oriented outlet rollers 53, 54 standing on edge. It will be understood that the terms "horizontal" and "vertical" as used herein are to be considered as only approximate in defining orientation. For example, the entire assembly may, if desired, be tilted with respect to the axis of the incoming stream without departing from the present invention. Accordingly the angle "substantially 90 degrees" as used herein shall be interpreted to include a right angle or a predominant portion of a right angle.

For the purpose of arresting and accumulating the overlapped signatures a remote stop is provided horizontally spaced from the nip 60 at the forming end of the stack. Such stop, indicated at 23 in FIG. 7, is preferably mechanically vibrated. For this purpose the stop 23 is mounted upon a rocker arm 90 which is connected to a link 91 having an eccentric connection 92 with a drive motor 93.

Figures 12, 13:
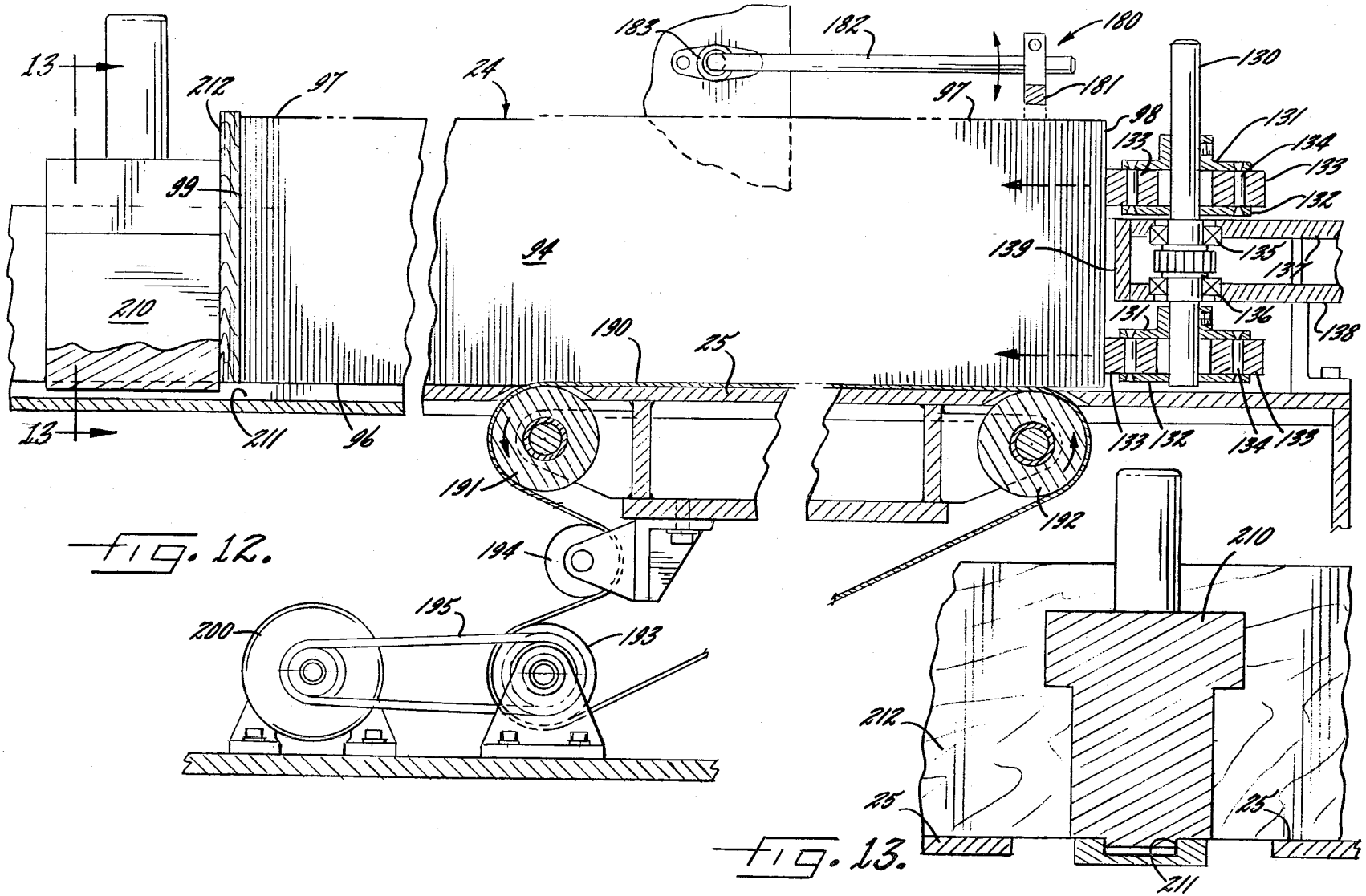
FIG. 12 is a vertical section looking along line 12—12 in FIG. 1 showing the stack conveyor.
FIG. 13 is a fragmentary cross section looking along line 13—13 in FIG. 12 showing the sliding weight seated on its way surface.

The remote stop 23 establishes the remote surface 94 of the stack 24. It will be helpful at this point to identify other significant surfaces on the stack including the "near" surface 95, the under surface 96, the top surface 97 (see also FIG. 12). The end of the stack where signatures are added may aptly be termed the "forming" end 98, with advancement of the stack, as signatures are added, taking place at the "leading" end 99.

Figure 8:
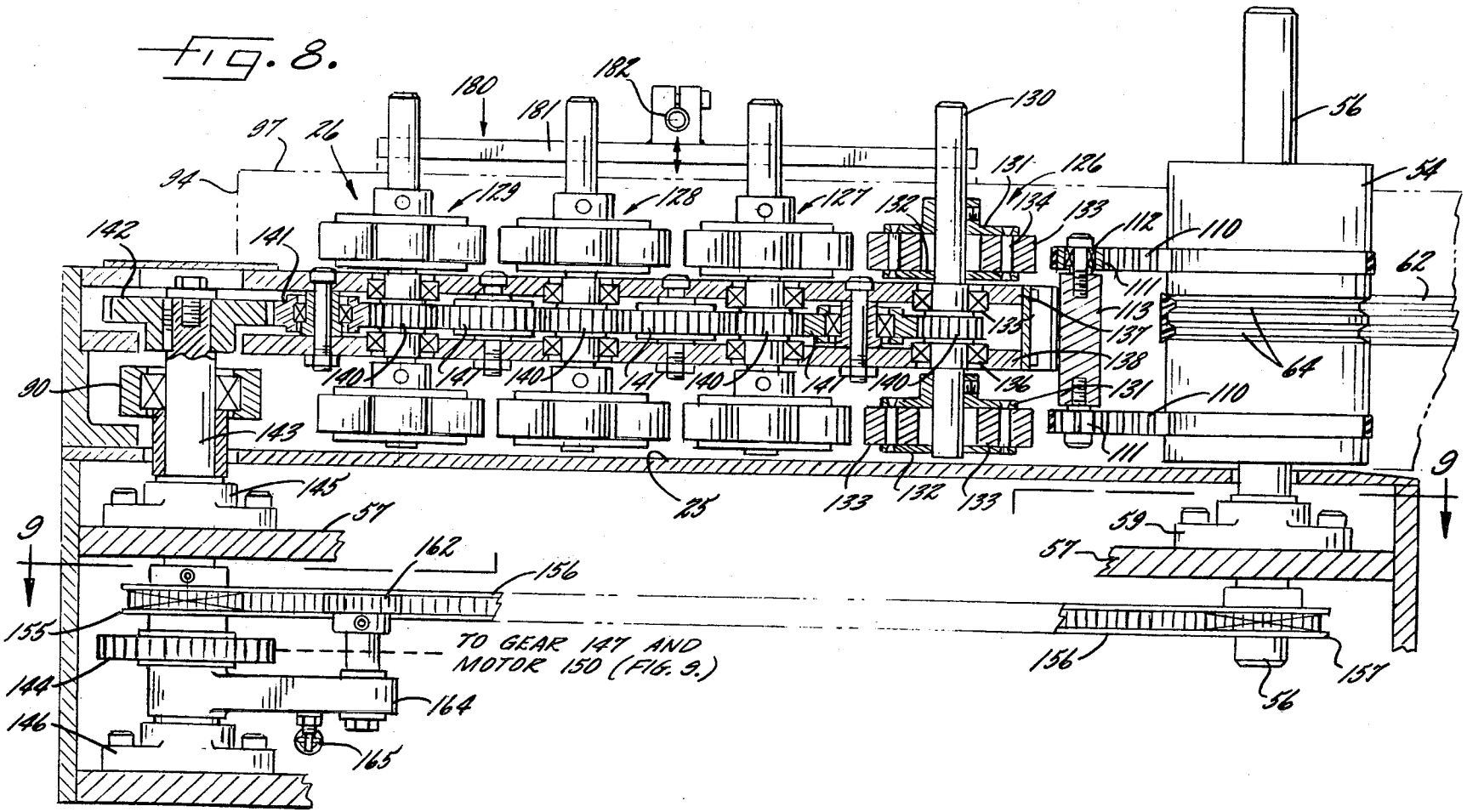
FIG. 8 is a view taken along line 8—8 in FIG. 7 showing the drive for the packer discs and twisting conveyor.
Figure 9:
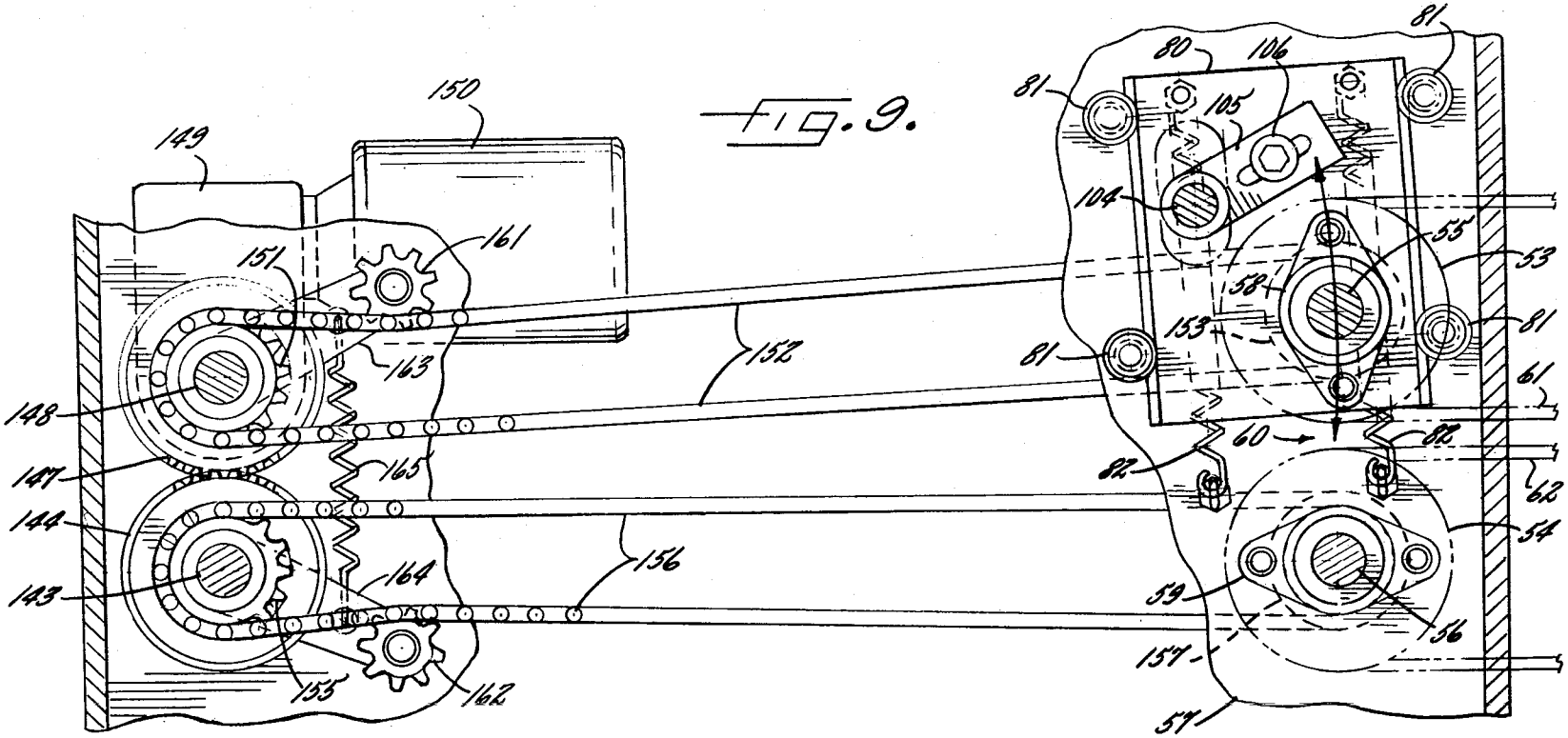
FIG. 9 is a horizontal section looking along line 9—9 in FIG. 8.

In accordance with the present invention an auxiliary bridging conveyor is provided including a loop of belt which is trained about the first outlet roller and about a pulley of relatively small diameter and which lies adjacent the "near" surface of the stack to form an auxiliary conveyor run. Such conveyor incrementally conveys the trailing edge of each signature from the nip 60 between the rollers across what normally is "dead space" and into a position which is flush with the near surface of the stack so that the leading edge of the signature is fully conveyed into engagement with the stop 23. Referring to FIGS. 7–10, the loop of belt providing an auxiliary conveying function is indicated at 100 and is trained about the roller 53 and a pulley 101 having a bearing 102. In carrying out the invention a pair of belts 100 are provided spaced axially side by side straddling the conveyor belt 61. The respective pulleys 101 are mounted for bodily movement with their associated output roller 53. Thus the bearings 102 of the pulleys are coaxially mounted upon an arm 103 which is secured to a shaft 104 at its upper end, the shaft being mounted in an adjustable bracket 105 which is anchored by a screw 106 to the movable frame plate 80 on which the roller 53 is journaled (FIG. 9). Thus when the roller 53 "opens" against its force of bias to spread the nip for accommodation of the incoming signatures, the pair of pulleys 101 are moved to equal degree. Preferably the pair of belts 100 are recessed in respective grooves 107 formed in the outlet roller.

Preferably also a second pair of belts are provided in opposition to the first pair of belts 100 the second pair of belts being trained about the second output roller 54 for engaging the opposite side of the incoming signatures. The second pair of belts indicated at 110 are trained about pulleys 111 having respective bearings 112 which are journaled on an arm 113 which is fixedly mounted to a shaft 114 upstanding from the table 25 of the machine (FIGS. 7 and 8).

In accordance with one of the important aspects of the present invention the first loop of belt 100 has a series of closely spaced outwardly presented cogs of uniform size and made of resilient material to propel the trailing edge portions of the signatures incrementally along the stream while the opposed loop of belt 110 presents a cooperating resilient, preferably smooth, surface. The second pulley 111 is, in addition, slightly advanced in the direction of the stream with respect to the corresponding first pulley 101 so that the engaged signatures are bent in the direction of movement of the stack and so that the trailing edge of the signature leaving the auxiliary conveyor tends to remain in engagement with the cog as it follows around its associated pulley for final movement of the signature into registered position. Thus I prefer to use, for the first belt 100, a doubly faced cog or timing belt made of rubber or the like reinforced with fabric having a first or outwardly facing set of cogs 121 and a second or inwardly facing set of cogs 122. The second belt 110 is a singly faced cog belt having only an inwardly facing set of cogs 123. The use of commercially available cog belts is preferred since the cross section of the belt between adjacent cogs is limited in the radial direction making it possible for pulleys 101, 111 of extremely small diameter to be employed, in a practical case $\frac{7}{8}$ inch or less, without causing fatigue which would shorten the life of the belt.

Figure 10:
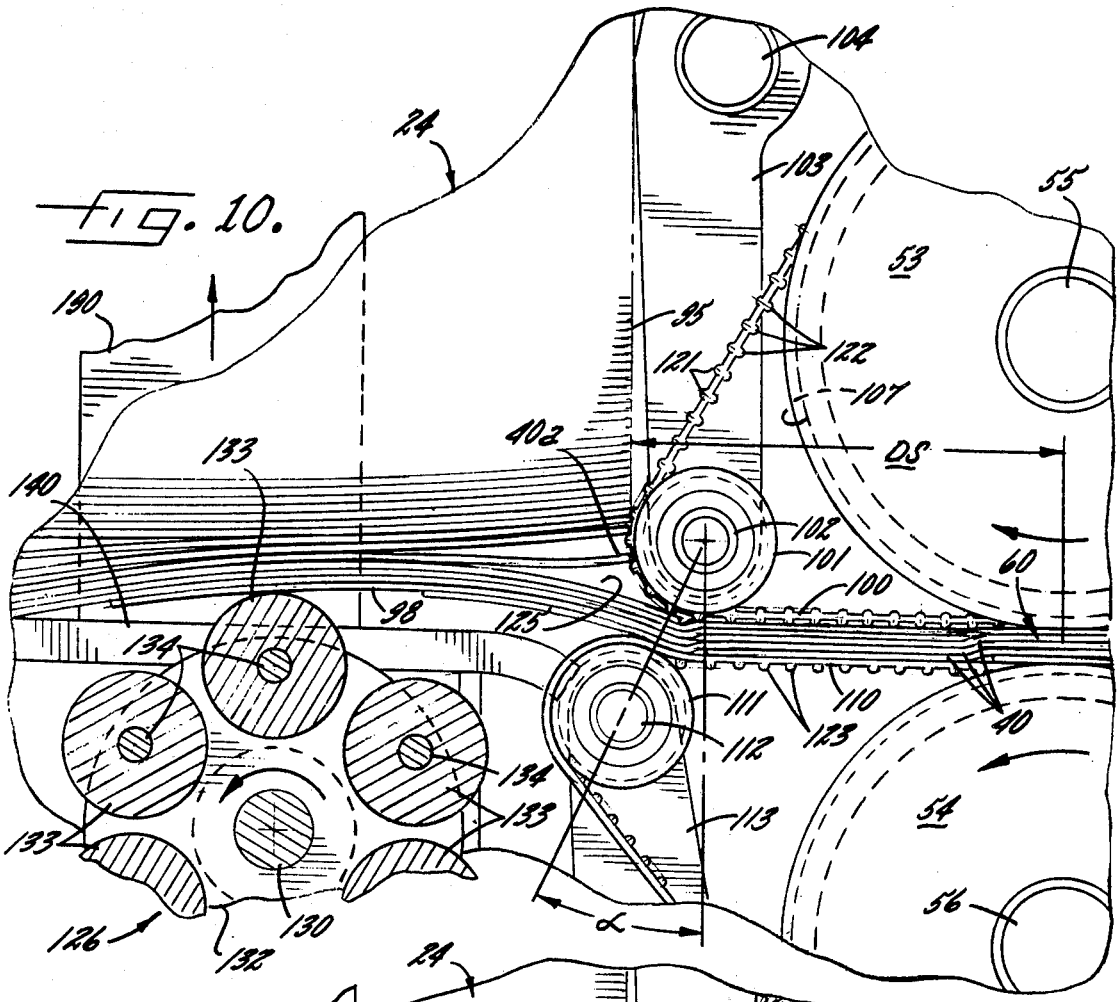
FIG. 10 is an enlarged fragment showing a roller on the packer disc impacting the forming end of the stack and showing the manner in which final movement is imparted to the trailing edge of a typical signature.

With regard to the advancement, or offset, of the second pulley 111, this is shown in FIG. 10 as an angle of advancement $\alpha$ taken about the axis of the first pulley 101, an angle which is on the order of 26 degrees. Measured in terms of distance along the stream of signatures, the advancement of the second pulley should preferably be in an amount which is slightly greater than the radius of the first pulley 101. As a result, the stream of incoming signatures is bent at an angle toward the stack 24. As illustrated in FIG. 10, this places the signatures under a slight bending stress so that when the trailing edge of a signature, indicated at 40*a*, clears the nip between the pulleys it tends to remain in engagement with the adjacent one of the cogs 121 on the belt 100. More specifically, the trailing edge 40*a* of a signature, upon release from the pulley nip, tends to straighten itself, and this straightening action maintains the trailing edge of the signature in contact with the adjacent cog on the belt which results in several advantages.

Prior to a discussion of these advantages mention should be made of the fact that the auxiliary conveyor belts 100, 110, acting in opposed pairs, overcome the "dead space" problem which exists when any attempt is made to discharge overlapping signatures from between a pair of outlet rollers, such as rollers 53, 54, directly into the forming end of an accumulating stack. Thus when the trailing end of a given signature leaves the nip between a pair of outlet rollers, the nip is no longer effective to transport the signature into contact with the remote stop and into register with the stack. Reliance must then be placed upon friction with the adjacent signatures which are still in contact with the nip to secure the final movement of the signature into registered position. While it is true that friction exists between a given signature and a signature which follows it, it is equally true that friction exists between each signature and the one which precedes it, thereby inhibiting the final sliding movement into registered position. This problem is particularly aggravated where the paper stock is of light gauge, resulting in a ragged looking bundle with projecting signatures which are easily, and almost inevitably, damaged. By use of the auxiliary bridging conveyor belts 100, 110 and their associated pulleys the effect of the dead space beyond the roller nips is overcome, and by advancing the second pulley 111 beyond the first pulley, the small amount of dead space associated with the pulley 101 is additionally overcome so that each signature is positively moved over the entire dead space region, indicated at DS in FIG. 10, which exists between the roller nip 60 and the near surface 95 of the stack.

Figure 11:
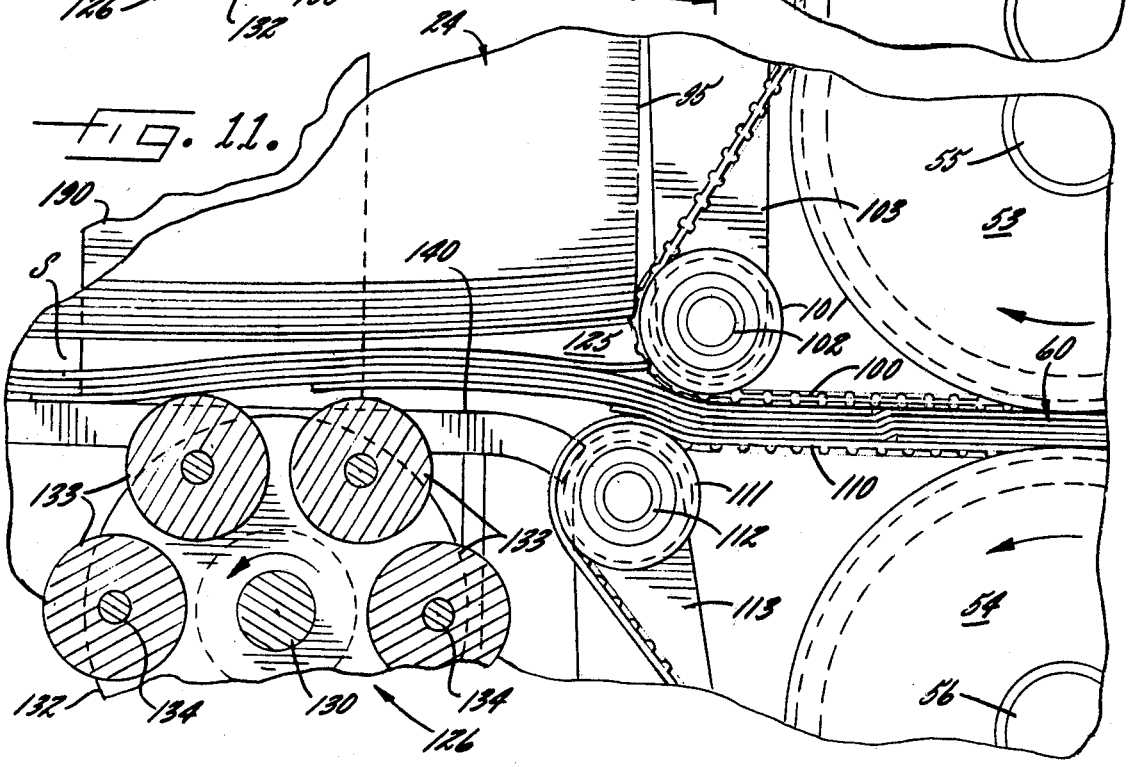
FIG. 11 is a stop motion view based on FIG. 10 and showing the release of pressure upon the incoming signatures to facilitate relative sliding into final registered position.

A further advantage of the belt and pulley geometry described above is that the trailing end of each signature, in addition to being advanced to the full extent required for striking of the remote stop, is "flicked" by the cog on the cog belt which engages it in the direction of movement of the stack thereby opening a V-shaped throat or entry way 125 (See FIGS. 10 and 11) into which oncoming signatures may be freely received.

While it is preferred to employ a second loop of auxiliary conveyor belt 110 in opposition to the first loop 100, the second loop is not essential in the practice of the invention and may be omitted provided that some hold-down and diverter means, as for example the pulley, or roller, 111 positioned as shown, is provided for relatively pressing the stream of signatures into contact with the loop of belt 100 and for bending the stream so that the stream has a component of motion in the length dimension of the stack, with the resulting advantage that the trailing end of each signature tends to remain in contact with the loop of belt as it passes around the pulley 101. Where the pulley, or roller 111 performs its function without the belt 110, it may, if desired, be enlarged in diameter from the size shown.

In accordance with a further aspect of the present invention means are provided for continuously beating upon the forming end 98 of the stack with rapidly repeated blows applied in unison and distributed over the area of the forming end. Preferably such beating means takes the form of a plurality of rotary beaters distributed in a plane adjacent the forming end with means for driving the beaters in synchronism. Such beating not only facilitates advancement of the stack as it is progressively built-up but also sliding of signatures over one another from the overlapped state into a condition of precise monolithic register. The beating means, indicated generally at 26 (see especially FIGS. 7 and 8) includes a set of rotary beaters 126–129. Taking the beater 126 as typical, it includes a shaft 130 having a pair of packer discs 131, 132 with packer rollers 133 equally spaced about the periphery of the disc and mounted for free rotation. Each packer disc is preferably made of a pair of axially spaced disc elements with each of the rollers 133 being freely journaled on a spindle 134. The rollers are preferably formed of nylon or similar durable plastic having slippery surface characteristics. It will be understood that the term "disc" as used herein is not limited to a member with a complete rounded periphery but is intended to cover a member for carrying a set of equally spaced rollers arranged at equal radii. Use of six rollers on each disc is preferred, but the number may be reduced without departing from the invention.

For the purpose of mounting each shaft 130 a pair of bearings 135, 136 are provided mounted in respective frame plates 137, 138, which together with a face plate 139, form a drive housing.

In carrying out the invention the shafts of all of the rotary beaters are mechanically coupled together so that corresponding rollers on each of the packer discs strike in unison with one another. Such coupling is obtained in the present instance by providing a gear 140 in the central portion of each of the drive shafts, the successive gears being interconnected by idlers 141, with the end idler being in mesh with a driving gear 142 secured to a shaft 143 which also mounts an input gear 144. The shaft 143 is journaled in spaced bearings 145, 146.

For driving the input gear 144 on the shaft 143, it is meshed with a similar gear 147 on a shaft 148. Such shaft is journaled in suitable bearings (not shown) which lie below stack level. The shaft 148 may be driven by a direct variable-ratio drive connection from the press drive. However, it is preferred to drive the shaft via a drive connection 149 from a motor 150.

In accordance with one of the aspects of the present invention, the same motor 150 which drives the packer discs serves also to drive the twisting conveyor. Referring to FIGS. 8 and 9, particularly the latter, the shafts 148, 143 carry drive sprockets which are respectively coupled to the outlet rollers 53, 54 for driving them at the same speed. Thus the shaft 148 mounts a drive sprocket 151 having trained about it a sprocket chain 152 which engages a driven sprocket wheel 153 on the shaft 55 of output roller 53, while the shaft 143 carries a drive sprocket 155 which drives a sprocket chain 156 which in turn is trained about a driven sprocket wheel 157 on the shaft 56 of output roller 54 (see FIG. 8). For keeping the chains taut, idler wheels 161, 162 are mounted respectively upon arms 163, 164 which are drawn together by a spring 165 connected between them.

Means are provided for "slaving" the motor 150 to the press drive 170 (FIG. 1*a*) so that the conveyor speed and beating rate are both coordinated with the speed of the press. This may be done in a number of ways. For example, the motor may be in the form of a power synchro receiver electrically connected to a power synchro transmitter or generator 171 which is mechanically driven by the press drive with interposed means 172 to adjust the drive ratio. Alternatively, the generator device 171 may be in the form of a tachometer and the ratio adjusting device may be in the form of an SCR control, energizing the motor 150 at a speed which is proportionally related to that of the tachometer and with the precise ratio being subject to manual adjustment. It will suffice to say that the exact form of connection between the press drive 170 and the motor 150 to produce a predetermined ratio of speed of the motor is a matter well within the skill of the art employing commercially available systems and devices so that the details of the electrical connection are not necessary for an understanding of the present invention.

The conveyor 41 (FIG. 1) (FIG. 1) which feeds signatures to the twisting conveyor 21 may be either powered by the motor 150 or directly by a rotating component in the press as a matter of designer's choice. With regard to the driving speed of the rotary beaters, they preferably have a peripheral speed, measured at the outer extent of the roller radius, which is greater than stream speed and preferably about three to six times stream speed. Using six rollers per disc the beating rate should preferably fall within the range of about 1,000 to about 2,500 beats per minute.

In accordance with one of the aspects of the present invention, in addition to the rotary beaters, which beat in a first plane, and a vibrating end stop, which vibrates at right angles thereto, there is provided a tamper at the forming end of the stack arranged to vibrate in a third plane, i.e., in a direction opposite the table which supports the stack. Such tamper, generally indicated at 180, includes a tamping head 181 which extends across the width of the stack at the forming end, the head being mounted upon an oscillating arm 182 pivoted at 183, the arm having a driving arm 184 connected to an actuator 185 preferably, but not necessarily, in the form of a motor driven eccentric of the type employed to vibrate the remote stop 23. As a result, blows are simultaneously applied to the accumulating signatures in all three planes to facilitate precise register with the stack.

In accordance with one of the further features of the construction a stack conveyor belt is provided at the surface of the horizontal supporting table 25 for advancing the stack and which is operated at a speed which is slightly greater than the speed of build-up of the stack, the beginning end of the conveyor belt being spaced slightly downstream from the forming end of the stack, say $\frac{3}{8}$–$\frac{1}{2}$ inch, so that the first few signatures adjacent the forming end are free of the conveyor. Thus turning to FIGS. 12 and 13, a conveyor belt 190 is shown riding upon the supporting surface 25 and trained about belt pulleys 191, 192 as well as about a drive pulley 193 and with an idler 194 interposed. The drive pulley 193 is coupled by a belt 195 to a drive motor 200. The latter motor is analogous to the motor 150 previously described. It is preferably energized by a generator 201 (FIG. 1*a*) which is mechanically coupled to the press drive 170 and which has an interposed device 202 for adjusting the drive ratio.

In carrying out the invention a slidable weight 210 is preferably provided on the table 25 the weight being slidable in a central way surface 211 extending longitudinally along the table and which is preferably recessed for purposes of guidance. With the way surface 211 occupying a central position, the stack conveyor belt 190 is preferably divided in two parts spaced side by side, and simultaneously driven, with the way surface extending between them (see FIG. 1). A suitably dimensioned back-up board 212 is preferably interposed between the weight and the leading end 99 of the stack. The weight 210 not only keeps the stack 24 standing upright but it is particularly useful in applying a force of resistance against stack movement when the stack is short or being initially formed.

By operating the conveyor belt 190 at a speed at least equal to the rate of formation of the stack, and which is preferably up to about five percent greater than the speed of formation, the stack may grow to almost any length without producing a correspondingly increased reaction force which would affect the consistency of operation of the rotary beaters. By spacing the beginning of the conveyor slightly downstream from the forming end of the stack the rotary beaters are required to act against only a consistent small number of accumulating signatures which exert a light, highly predictable, reaction force. In short the rotary beaters can be adjusted for optimum consistent operation and need not be readjusted in accordance with the varying length of the stack.

While, for the sake of simplicity, the device has been described in terms of its separate sections, it is found that there is a high degree of synergism between the various component parts, as will be made clear by considering a typical operating cycle: With the press operating normally, producing signatures at a predetermined rate, such signatures are fed in overlapping relation along the conveyor 41 (FIG. 1) into the inlet of the twisting conveyor 21 where the signatures are trapped between the face-to-face runs of the belts 61, 62. The signatures are progressively twisted through a helical path, exiting from the roller nip 60 in the vertical condition, that is, standing on edge on the stack supporting table 25. Because of the auxiliary bridging conveyor formed by the belts 100,110, and additionally by the fact that the pulley 111 which supports the second belt is advanced with respect to the pulley 101 as measured in the stream direction, the leading one of the signatures being transported is positively driven across the normal "dead space" (DS in FIG. 10) so that its leading edge engages the remote stop 23 and is positively positioned by the latter, without relying upon friction between the registering signature and the one next in sequence. Moreover, offsetting the pulley 111 in the stream direction results in angling of the incoming signatures in the direction of the stack so that when the trailing edge of the registering signature passes from the pulley nip such trailing edge, tending to straighten, follows the cog belt 100 in its path of movement about the pulley 101. Thus the cog which engages the trailing edge of the signature not only moves the signature forwardly against the stop but flicks the trailing end of the signature in the direction of movement of the stack to open up a wedge-shaped throat or clearance space 125 insuring that the entry and register of the next signatures in the series will be free and unobstructed.

Simultaneously the rotary beaters, in the form of the packer discs, facilitate the advancement of the stack and sliding of the signatures one over another from the overlapped state. The rotary beaters provide only momentary contact applied by the packer rollers in unison over the forming end of the stack followed by a relatively longer period over which the force is reduced to zero in readiness for a new cycle. Impact and release are respectively illustrated at FIGS. 10 and 11. In FIG. 10 the packer roller 133 is shown applying a blow to the forming end of the stack. This blow imparts feeding movement to the stack momentarily compressing it, and since the blow is applied for such a short time it does not substantially affect the normal flow of registering signatures. Indeed, because of the fact that the discs are driven so that the periphery of the rollers is in the same direction as the stream and at a substantially higher velocity than the stream, entry of the signatures during the duration of the blow is actually improved. In any event during the period following impact the incoming signatures rebound creating a clearance spaced indicated at S in which there is a layer of air between the last fully registered signature and the signature, in the act of register, which immediately follows. Thus the signature which is in the act of register is, during the intervals between impact, out of frictional engagement with the stationary signature which preceded it but in frictional engagement with the signatures which follows. As a result it is seen that each signature during its final registering movement is advanced by two separate effects: the cog belt which engages its trailing edge and by frictional engagement with its lateral surface. However, unlike certain conventional stacking mechanisms, no reliance is placed upon friction. Additionally, it may be observed, the release of compression following impact, and the extent to which there is rebound from the impact, creates an air space S thereby obviating frictional drag during the final critical portion of the registering movement of each signature. The practical result is to produce a stack in which each signature is in perfect register, a stack which the sides are so smooth as to give a monolithic appearance. High precision is achieved even when handling signatures made of thin or flimsy paper stock, stock which almost always presents problems in bundlers of more conventional design.

When the stack has grown to a length considered adequate for bundling, the weight 210 and its associated retainer board 212 are temporarily removed and a portion of the stack, which is to form the bundle, indicated at 30 in FIG. 1, is moved to the end of the table into engagement with the fixed stop 31. Extending under the table 25, adjacent its end, is a pneumatic actuator 33 which is coupled to the jaws 32 previously mentioned. Contraction of the actuator, pressing the stack between the jaws 32 and the end stop 31, compresses the bundle so that it may be either strapped on the table while it is in its compressed state or picked up by an overhead crane having a pair of compressing jaws to maintain the bundle in the compressed state for strapping in an adjacent operating position. Because the bundle 30 is formed horizontally, greater lengths of stack may be allowed to accumulate so that the stack supporting table 25, as already indicated, provides buffer storage to lengthen the intervals between unloading.

It is found that bundlers of present design not only produce a more precisely registered stack of signatures but are capable of keeping up with the production of the most rapid state-of-the-art printing equipment. Indeed, bundlers of the present design have a speed capability suiting them for use with super speed presses not yet available but which may be the subject of future designs.

The bundler is capable of universal usage for bundling signatures having a wide range of face dimension and thickness. Thus where it is desired to accommodate the bundler to signatures having a larger format than illustrated in the drawings, an additional packer disc may be secured to the upper ends of the shafts 130 of beaters 126–129 (FIG. 8), and roller extensions may be added to the upper ends of the shafts 55, 56.

The bundler, also, is capable of operating successfully over a wide range of overlap and is even capable of operating with accidentally "underlapped" signatures, a condition which most bundlers are not equipped to handle.

The present bundler is not only suited for the handling of signatures intended for subsequent combination into a completed volume but is capable of handling, if desired, completed volumes fed in succession from an assembling or binding machine.

It will be apparent to one skilled in the art that the present construction is elegantly simple and does not rely upon any critical adjustment or maintenance of critical tolerances—it is found that bundlers of present design may be constructed at approximately one-half of the cost of those of more conventional design intended for the same service. Moreover, the construction is inherently long wearing so that down time is minimized and long intervals may exist between periodic maintenance procedures.

What I claim is:

1. In a bundling mechanism for receiving a stream of signatures in overlapping relation on a generally horizontal conveyor belt and for stacking them in register with one another preparatory to separation into bundles for transfer or storage, the combination of means including a twisting conveyor having an inlet and an outlet for receiving the stream of signatures from the conveyor belt and for conveying them at stream speed while twisting the stream substantially 90 degrees so that the signatures are placed on edge, the outlet of the twisting conveyor being formed of a pair of vertically oriented rollers arranged in opposition to one another to form an outlet nip, a generally horizontal stack supporting table for receiving the lower edges of the signatures and extending at right angles to the direction of the stream to accommodate a horizontally oriented stack having a forming end, a remote stop at the forming end horizontally spaced from the nip for arrest and accumulation of the signatures and against which the leading edges of the accumulating signatures are advanced thereby to establish the remote surface of the stack, the near surface of the stack being horizontally spaced from the nip thereby defining a dead space over which the roller nip is ineffective to transport a signature into contact with the stop and into register with the stack, an auxiliary bridging conveyor located adjacent the nip and in alignment with the stream and driven substantially at stream speed for incrementally conveying the trailing edge of each signature from the nip across the dead space and into a position which is flush with the near surface of the stack and so that the leading edge of the signature is fully conveyed into engagement with the stop, and means for continuously beating upon the forming end of the stack with rapidly repeated blows distributed over the area of the forming end, the blows being applied substantially in unison to facilitate advancement of the stack and sliding of the signatures one over another from the overlapped state into a condition of precise monolithic register.

2. In a bundling mechanism for receiving a stream of signatures in overlapping relation on a generally horizontal conveyor belt and for stacking them in register with one another preparatory to separation into bundles for transfer or storage, the combination of means including a twisting conveyor having an inlet and an outlet for receiving the stream of signatures from the conveyor belt and for conveying them at stream speed while twisting the stream substantially 90 degrees so that the signatures are placed on edge, the outlet of the twisting conveyor being formed of first and second vertically oriented outlet rollers of relatively large diameter arranged in opposition to one another and respectively engaging the lapped sides of the stream to form an outlet nip, a generally horizontal stack supporting table for receiving the lower edges of the signatures and extending at right angles to the direction of the stream to accommodate a horizontally oriented stack having a forming end, a remote stop at the forming end horizontally spaced from the nip for arrest and accumulation of the signatures and against which the leading edges of the accumulating signatures are advanced thereby to establish the remote surface of the stack, the near surface of the stack being horizontally spaced from the nip thereby defining a dead space over which the roller nip is ineffective to transport a signature into contact with the stop and into register with the stack, a relatively small diameter pulley located adjacent the near surface of the stack, an auxiliary bridging conveyor including a loop of belt trained about the first outlet roller and about the pulley to form an auxiliary conveyor run for incrementally conveying the trailing edge of each signature from the nip across the dead space and into a position which is flush with the near surface of the stack and so that the leading edge of the signature is fully conveyed into engagement with the stop, and means for continuously beating upon the forming end of the stack with rapidly repeated blows distributed over the area of the forming end, the blows being applied substantially in unison to facilitate advancement of the stack and sliding of the signatures one over another from the overlapped state into a condition of precise monolithic register in the stack.

3. The combination as claimed in claim 2 in which the auxiliary conveyor includes a plurality of loops of belt symmetrically arranged side by side along the first outlet roller.

4. The combination as claimed in claim 2 in which the loop of belt forming the auxiliary bridging conveyor has a series of closely spaced outwardly presented cogs of uniform size and made of resilient material for propelling the trailing edge portion of each signature incrementally along the stream.

5. The combination as claimed in claim 4 in which the loop of belt is in the form of a doubly-faced cog belt having cogs on both sides.

6. In a bundling mechanism for receiving a stream of signatures in overlapping relation on a generally horizontal conveyor belt and for stacking them in register with one another preparatory to separation into bundles for transfer or storage, the combination of means including a twisting conveyor having an inlet and an outlet for receiving the stream of signatures from the conveyor belt and for conveying them at substantially stream speed while twisting the stream approximately 90 degrees so that the signatures are placed on edge, the outlet of the twisting conveyor being formed of first and second vertically oriented outlet rollers of relatively large diameter arranged in opposition to one another and respectively engaging the lapped sides of the stream to form an outlet nip, a generally horizontal stack supporting table for receiving the lower edges of the signatures and extending at right angles to the direction of the stream to accommodate a horizontally oriented stack having a forming end, a remote stop at the forming end horizontally spaced from the nip for arrest and accumulation of the signatures and against which the leading edges of the accumulating signatures are advanced thereby to establish the remote surface of the stack, the near surface of the stack being horizontally spaced from the nip thereby defining a dead space over which the roller nip is ineffective to transport a signature into contact with the stop and into register with the stack, first and second pulleys are relatively arranged in opposition to one another adjacent the near surface of the stack, the auxiliary bridging conveyor including first and second opposedly arranged loops of belt trained about the respective outlet rollers and about respective ones of the pulleys to form an auxiliary conveyor run for incrementally conveying the trailing edge of each signature from the nip across the dead space and into a position which is flush with the near surface of the stack and so that the leading edge of the signature is conveyed into engagement with the stop, and means for continuously beating upon the forming end of the stack with rapidly repeated blows distributed over the area of the forming end, the blows being applied substantially in unison to facilitate advancement of the stack and sliding of the signatures one over another from the overlapped state into a condition of precise monolithic register in the stack.

7. The combination as claimed in claim 6 in which the second pulley, while being arranged generally in opposition to the first pulley, is incrementally advanced in the direction of the stream so that each signature, upon exit from the auxiliary bridging conveyor has a component of movement in the direction of the movement of the stack.

8. The combination as claimed in claim 6 in which the first loop of belt has a series of closely spaced outwardly presented cogs of uniform size and made of resilient material to propel the trailing edge portions of the signatures incrementally along the stream while the second loop of belt presents a cooperating resilient surface, the second pulley being slightly advanced in the direction of the stream with respect to the first pulley so that the engaged signatures are bent in the direction of movement of the stack and so that the trailing edge of a signature leaving the auxiliary conveyor tends to remain in engagement with a cog as it follows its associated pulley for final movement of the signature into registered position accompanied by lateral flicking of the trailing edge of the signature in the direction of movement of the stack.

9. In a bundling mechanism for receiving a stream of signatures in overlapping relation on a generally horizontal conveyor belt and for stacking them in register with one another preparatory to separation into bundles for transfer or storage, the combination comprising a twisting conveyor having a pair of inlet rollers and a pair of outlet rollers arranged at substantially 90 degrees with respective rollers of each pair being interconnected by narrow centrally positioned twisting conveyor belts having adjacent conveying runs face to face for gripping of the stream of signatures between them, means for driving the belts at substantially stream speed so that the signatures are advanced while being twisted in a helical path so that they are discharged in vertically oriented position, the outlet rollers being opposed to one another to form an outlet nip, a generally horizontal stack supporting surface for receiving the lower edges of the twisted signatures and extending at right angles to the direction of the stream to accommodate a horizontally oriented stack having a forming end, a remote stop at the forming end horizontally spaced from the nip for arrest and accumulation of the signatures and against which the leading edges of the accumulating signatures are advanced thereby to establish the remote surface of the stack, the near surface of the stack being horizontally spaced from the nip thereby defining a dead space over which the roller nip is ineffective to transport a signature into contact with the stop and into register with the stack, an auxiliary bridging conveyor located adjacent the nip and in alignment with the stream and driven substantially at stream speed for incrementally conveying the trailing edge of each signature from the nip across the dead space and into a position which is flush with the near surface of the stack and so that the leading edge of the signature is fully conveyed into engagement with the stop, and means for continuously beating upon the forming end of the stack with rapidly repeated blows distributed over the area of the forming end, the blows being applied substantially in unison to facilitate advancement of the stack and of the signatures one over another from the overlapped state into a condition of precise monolithic register.

10. The combination as claimed in claim 9 in which the outlet rollers have opposed annular grooves for substantially accommodating the radial thickness of the twisting conveyor belts.

11. The combination as claimed in claim 9 in which the twisting conveyor belts are in the form of a single pair of belts opposed face to face, each belt of the pair being formed of two "V" elements symmetrically spaced side by side yet integral with one another, each of the rollers having a central double groove for registeringly accommodating a respective one of the belts, and means including a plurality of opposed pairs of idler rollers captively engaging the back sides of the belts at the conveying run to distribute the total twist evenly along the helical path.

12. In a bundling mechanism for receiving a stream of signatures in overlapping relation on a generally horizontal conveyor belt and for stacking them in register with one another preparatory to separation into bundles for transfer or storage, the combination of means including a twisting conveyor having an inlet and an outlet for receiving the stream of signatures from the conveyor belt and for conveying them at stream speed while twisting the stream substantially 90 degrees so that the signatures are placed on edge, the outlet of the twisting conveyor being formed of a pair of vertically oriented rollers arranged in opposition to one another to form an outlet nip, a generally horizontal stack supporting table for receiving the lower edges of the signatures and extending at right angles to the direction of the stream to accommodate a horizontally oriented stack having a forming end, a remote stop at the forming end horizontally spaced from the nip for arrest and accumulation of the signatures and against which the leading edges of the accumulating signatures are advanced thereby to establish the remote surface of the stack, the near surface of the stack being horizontally spaced from the nip thereby defining a dead space over which the roller nip is ineffective to transport a signature into contact with the stop and into register with the stack, an auxiliary bridging conveyor located adjacent the nip and in alignment with the stream and driven substantially at stream speed for incrementally conveying the trailing edge of each signature from the nip across the dead space and into a position which is flush with the near surface of the stack and so that the leading edge of the signature is fully conveyed into engagement with the stop, and means for continuously beating upon the forming end of the stack with rapidly repeated blows applied in unison and distributed over the area of the forming end, said beating means including a plurality of rotary beaters distributed in a plane adjacent the forming end with means for driving the beaters in synchronism to facilitate advancement of the stack and sliding of the signatures one over another from the overlapped state into a condition of precise monolithic register.

13. The combination as claimed in claim 12, the rotary beaters being in the form of drive shafts each having anti-friction beater elements spaced at equal angles and extending to equal radii with the drive shafts being phased so that corresponding beater elements strike the forming end of the stack in unison.

14. The combination as claimed in claim 12, the beaters each being formed of a set of discs axially spaced and keyed to the drive shaft, the discs each having beater elements in the form of freely rotatable rollers equally spaced about the periphery.

15. The combination as claimed in claim 12 in which the conveyor belt, twisting conveyor, auxiliary bridging conveyor and rotary beaters are all synchronously coupled to a common driving means so that their speeds are varied in unison as the speed of the driving means is changed.

16. The combination as claimed in claim 15 in which a stack conveyor is provided at the stack supporting surface having its beginning end spaced slightly downstream from the forming end of the stack so that the first few signatures adjacent the forming end are free of the conveyor, and means for coupling the stack conveyor to the driving means at such a drive ratio that the speed of the conveyor is slightly more than the speed of build-up of the stack.

17. In a bundling mechanism for receiving a stream of signatures in overlapping relation and for stacking them in register with one another preparatory to separation into bundles for transfer or storage, the combination comprising outlet means for the stream of signatures including a pair of vertically oriented outlet rollers arranged in opposition to one another to form an outlet nip with the signatures therefrom being vertically oriented, a generally horizontal stack supporting table for receiving the lower edges of the signatures and extending at right angles to the direction of the stream to accommodate a horizontally oriented stack having a forming end, a remote stop at the forming end horizontally spaced from the nip for arrest and accumulation of the signatures and against which the leading edges of the accumulating signatures are advanced thereby to establish the remote surface of the stack, the near surface of the stack being horizontally spaced from the nip thereby defining a dead space over which the roller nip is ineffective to transport a signature into contact with the stop and into register with the stack, an auxiliary bridging conveyor located adjacent the nip and in alignment with the stream and driven substantially at stream speed for incrementally conveying the trailing edge of each signature from the nip across the dead space and into a position which is flush with the near surface of the stack and so that the leading edge of the signature is fully conveyed into engagement with the stop, and rotary beaters for continuously beating upon the forming end of the stack with rapidly repeated blows distributed over the area of the forming end, said beaters including respective shafts spaced in a plane side by side in the direction of the stream, each of the shafts having secured thereto in axially spaced positions a series of packer discs having a set of axially oriented packer rollers freely journaled in spaced positions about the periphery thereof, and means for driving the shafts in unison so that the rollers strike the forming end of the stack in synchronism to facilitate sliding of the signatures one over another from the overlapped state into a condition of precise monolithic register.

18. The combination as claimed in claim 12 or in claim 17 in which the rotary beaters are driven in the direction of the stream and at a speed greater than stream speed.

19. The combination as claimed in claim 12 or in claim 17 in which the rotary beaters are driven at a peripheral speed lying within the range of approximately three to approximately six times the stream speed.

20. The combination as claimed in claim 12 or in claim 17, the beating rate being within the range of about 1,000 to about 2,500 beats per minute.

21. The combination as claimed in claim 12 or in claim 17 in which a stack conveyor belt is provided for supporting the stack at the surface of the horizontal supporting table, the speed of the stack conveyor belt being slightly greater than the rate of build-up of the stack.

22. The combination as claimed in claim 12 or in claim 17 in which the horizontal stack supporting surface includes a recessed way surface extending in the direction of the stack, a weighty element being slideably mounted in the way surface in the path of movement of the leading end of the stack opposite the forming end for inhibiting movement of the leading end for maintenance of a compact stack.

23. In a bundling mechanism for receiving a stream of signatures in overlapping relation on a conveyor belt and for stacking them in register with one another preparatory to separation into bundles for transfer or storage, the combination comprising outlet means for the stream of signatures including a pair of vertically oriented outlet rollers arranged in opposition to one another to form an outlet nip with the signatures therefrom being vertically oriented, a generally horizontal stack supporting table for receiving the lower edges of the signatures and extending at right angles to the direction of the stream to accommodate a horizontally oriented stack having a forming end, a remote stop at the forming end horizontally spaced from the nip for arrest and accumulation of the signatures and against which the leading edges of the accumulating signatures are advanced thereby to establish the remote surface of the stack, a tamper at the forming end of the stack in contact therewith and arranged opposite the supporting table, the near surface of the stack being horizontally spaced from the nip thereby defining a dead space over which the roller nip is ineffective to transport a signature into contact with the stop and into register with the stack, an auxiliary bridging conveyor located adjacent the nip and in alignment with the stream and driven substantially at stream speed for incrementally conveying the trailing edge of each signature from the nip across the dead space and into a position which is flush with the near surface of the stack and so that the leading edge of the signature is fully conveyed into engagement with the remote stop, means for continuously beating upon the forming end of the stack with rapidly repeated blows applied in unison over the area of the forming end, and means for vibrating the remote stop and the tamper so that blows are simultaneously applied to the accumulating signatures in all three planes to facilitate precise register with the stack.

24. In a bundling mechanism for receiving a stream of signatures in overlapping relation on a conveyor belt and for stacking them in register with one another preparatory to separation into bundles for transfer or storage, the combination comprising outlet means for the stream of signatures including first and second vertically oriented outlet rollers arranged in opposition to one another to form an outlet nip, a generally horizontal supporting table for receiving the lower edges of the signatures and extending at right angles to the direction of the stream to accommodate a horizontally oriented stack having a forming end, a remote stop at the forming end horizontally spaced from the nip for arrest and accumulation of the signatures and against which the leading edges of the accumulating signatures are advanced thereby to establish the remote surface of the stack, the near surface of the stack being horizontally spaced from the nip thereby defining a dead space over which the roller nip is ineffective to transport a signature into contact with the stop and into register with the stack, the first outlet roller having an associated relatively small diameter pulley generally aligned with the nip surface of the first outlet roller and located adjacent the near surface of the stack, an auxiliary bridging conveyor including a loop of belt trained about the first outlet roller and about the pulley to form an auxiliary conveyor for incrementally conveying the trailing edge of each signature from the nip across the dead space and into a position which is flush with the near surface of the stack and so that the leading edge of the signature is fully conveyed into engagement with the stop, diverter means associated with the second outlet roller spaced in opposition to the pulley for relatively pressing the stream of signatures into contact with the loop of belt and offset from the pulley in the direction of flow of the stream for diverting the stream so that the stream is bent in the direction of the stack and so that the trailing end of each signature tends to remain in contact with the loop of belt as it passes around the pulley, the first outlet roller and its associated pulley being relatively movable with respect to the second roller and its associated diverter means and biased thereagainst for accommodating variations in the thickness of the stream, and means for continuously beating upon the forming end of the stack with rapidly repeated blows distributed over the area of the forming end, the blows being applied substantially in unison to facilitate advancement of the stack and sliding of the signatures one over another from the overlapped state into a condition of precise monolithic register in the stack.

* * * * *